US007461411B2

(12) United States Patent
Wolf

(10) Patent No.: US 7,461,411 B2
(45) Date of Patent: Dec. 9, 2008

(54) TOILET TRAINING SYSTEM

(76) Inventor: Richard Wolf, 12810 Countryview La., Burnsville, MN (US) 55337

( * ) Notice: Subject to any disclaimer, the term of this patent is extended or adjusted under 35 U.S.C. 154(b) by 295 days.

(21) Appl. No.: 11/256,804

(22) Filed: Oct. 24, 2005

(65) Prior Publication Data

US 2007/0089225 A1 Apr. 26, 2007

(51) Int. Cl.
*A47K 13/06* (2006.01)

(52) U.S. Cl. ..... 4/239; 4/254; 4/DIG. 5

(58) Field of Classification Search ..... 4/239, 4/254, 237, 300.3, DIG. 5
See application file for complete search history.

(56) References Cited

U.S. PATENT DOCUMENTS 588,304 A * 8/1897 Weston ..... 4/237 X
817,731 A * 4/1906 Baily ..... 4/239
2,940,086 A * 6/1960 Wondrack ..... 4/239
3,392,411 A * 7/1968 Hansen ..... 4/239
3,931,649 A 1/1976 Jankowski
3,971,077 A * 7/1976 O'Neil ..... 4/239
D245,425 S 8/1977 Annis
4,060,859 A 12/1977 Anderson
4,348,776 A 9/1982 Sarjeant
4,777,672 A 10/1988 Gebhard et al.
4,912,784 A 4/1990 Jacobson et al.
5,117,512 A 6/1992 Bressler
5,182,818 A 2/1993 Nawoj
6,112,339 A 9/2000 Nichols et al.
6,357,055 B1 3/2002 Gambla et al.
6,385,785 B1 5/2002 Linden

* cited by examiner

*Primary Examiner*—Robert M Fetsuga
(74) *Attorney, Agent, or Firm*—Michael A. Kondzella

(57) ABSTRACT

A toilet training system is usable in both a child's sit-down toilet mode and a child's stand-up urinal mode. The system includes a child-sized toilet seat, a vertical curvilinear element, and a padded liner for the curvilinear element. The vertical curvilinear element functions alternatively as a backrest for the child-sized toilet seat in the child's sit-down toilet mode or as a urine shield in the child's stand-up urinal mode.

7 Claims, 4 Drawing Sheets

TOILET TRAINING SYSTEM

BACKGROUND OF THE INVENTION

1. Field of the Invention

The present invention relates to toilet training. In one of its more particular aspects it relates to a multi-purpose system which is useful in toilet training.

2. Description of the Related Art

Many types of toilet training devices, which facilitate the use of toilets by children, are known. For example, toilet seats specially designed and sized for use by children have become available. In addition, various kinds of splash shields have been provided to simulate a urinal for use by boys when urinating while standing at a toilet. Since boys frequently spray urine on the toilet seat as well as the back of the toilet, the floor, and elsewhere when using the toilet as a urinal, splash shields have been provided to deflect urine spray away from such areas. No simple system is known, however, which can function as both a child's sit-down toilet and a child's stand-up urinal. It would be desirable to provide such a multi-purpose system.

SUMMARY OF THE INVENTION

The present invention provides an easy to use toilet training system for both boys and girls and methods for its use. The system is provided in the form of accessories for a conventional full-sized toilet, which can be readily installed upon the toilet. The system includes a child-sized toilet seat, which may be padded, if desired, a vertical curvilinear element, which is positioned at the rear of the full-sized toilet to function alternatively as a urine shield or as a backrest for the child-sized toilet seat, and a padded liner for use with the vertical curvilinear element when it functions as a backrest. An optional urine deflector, which can be attached to the child-sized toilet seat, may also be provided for use by girls while sitting on the toilet seat.

For use as a child's sit-down toilet, the vertical curvilinear element is fitted to a conventional full-sized toilet to function as a backrest, the padded liner is positioned in front of the vertical curvilinear element to function as a comfortable cushion for the backrest, and the child-sized toilet seat, with the urine deflector attached, if desired, is inserted between the resulting cushioned backrest and the front of the toilet bowl of the toilet.

The versatility of the toilet training system of the present invention can be seen from the fact that conversion from a child's sit-down toilet to a child's stand-up urinal merely requires removing the padded liner and the child-sized toilet seat, whereas conversion from a child's stand-up urinal to a child's sit-down toilet merely requires adding the padded liner and the child-sized toilet seat.

DETAILED DESCRIPTION OF THE INVENTION

Figure 1:
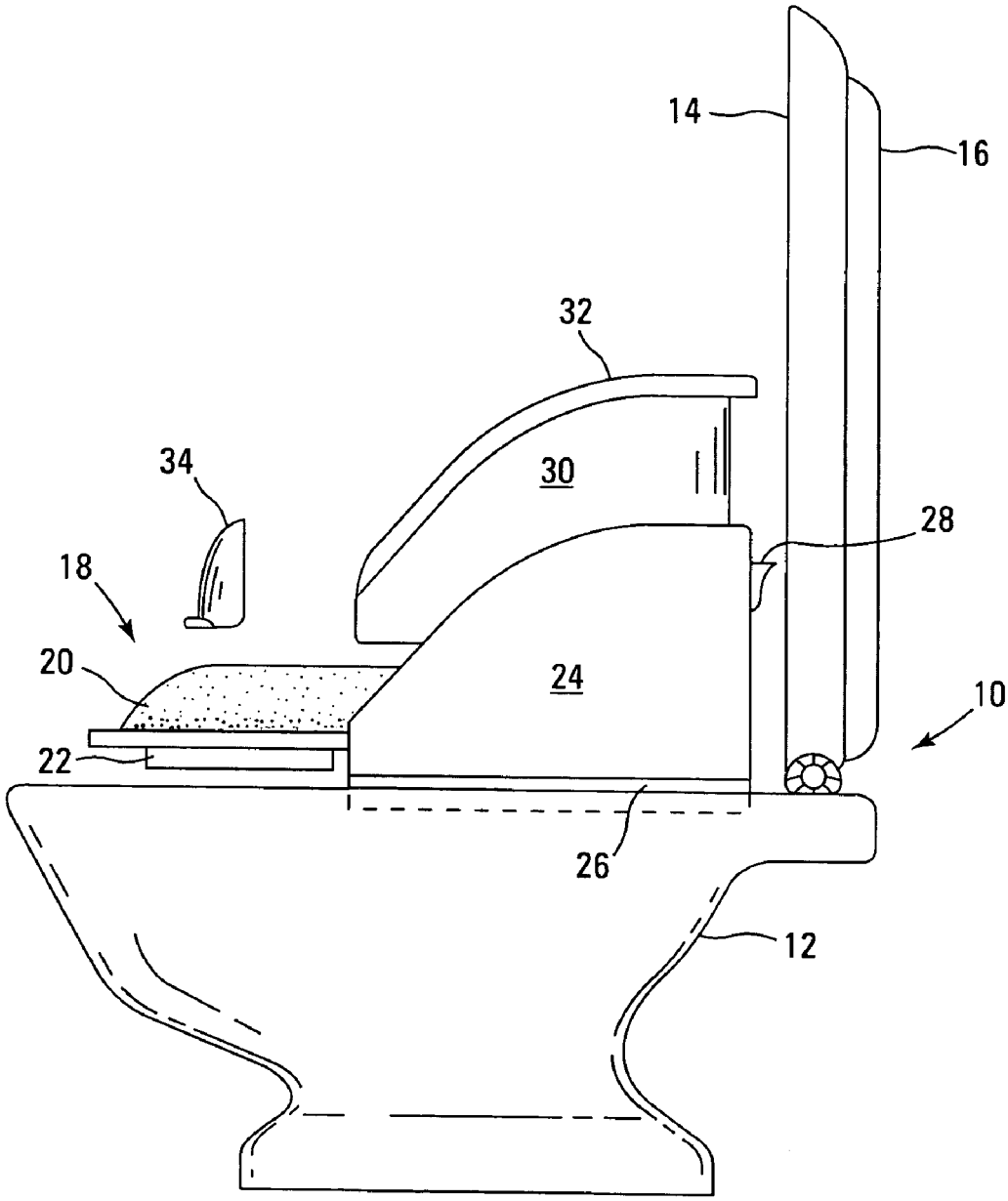
FIG. 1 is a side elevational view, partially expanded, of a conventional full-sized toilet fitted with the toilet training system of the present invention, including a padded child-sized toilet seat, a vertical curvilinear element, a padded liner for the curvilinear element, and a urine deflector.

The present invention provides a toilet training system which can be used by both boys and girls and is particularly adapted for alternative use by boys while standing in front of a toilet to urinate and by both boys and girls while sitting on the toilet seat. A vertical curvilinear element serves both as a urine shield when the toilet is being used by boys while standing and as a backrest when the toilet is being used by boys or girls while sitting. The invention will be better understood by reference to the drawings, in which similar parts are indicated by use of the same reference numeral in each of the figures in which that part is depicted.

Referring now to FIG. 1, the numeral 10 represents a conventional full-sized toilet having a toilet bowl 12, a toilet seat 14, and a toilet seat cover 16. A child-sized toilet seat 18 having padding 20 and a vertical lip 22 is shown in a position slightly above toilet bowl 12. A vertical curvilinear element 24 having a horizontal rest 26 and a handle 28 is fitted to the rear portion of toilet bowl 12 and a padded liner 30 having an overhang 32, shown in a raised position, is positioned in front of vertical curvilinear element 24. A urine deflector 34 is shown detached from child-sized toilet seat 18.

Figure 2:
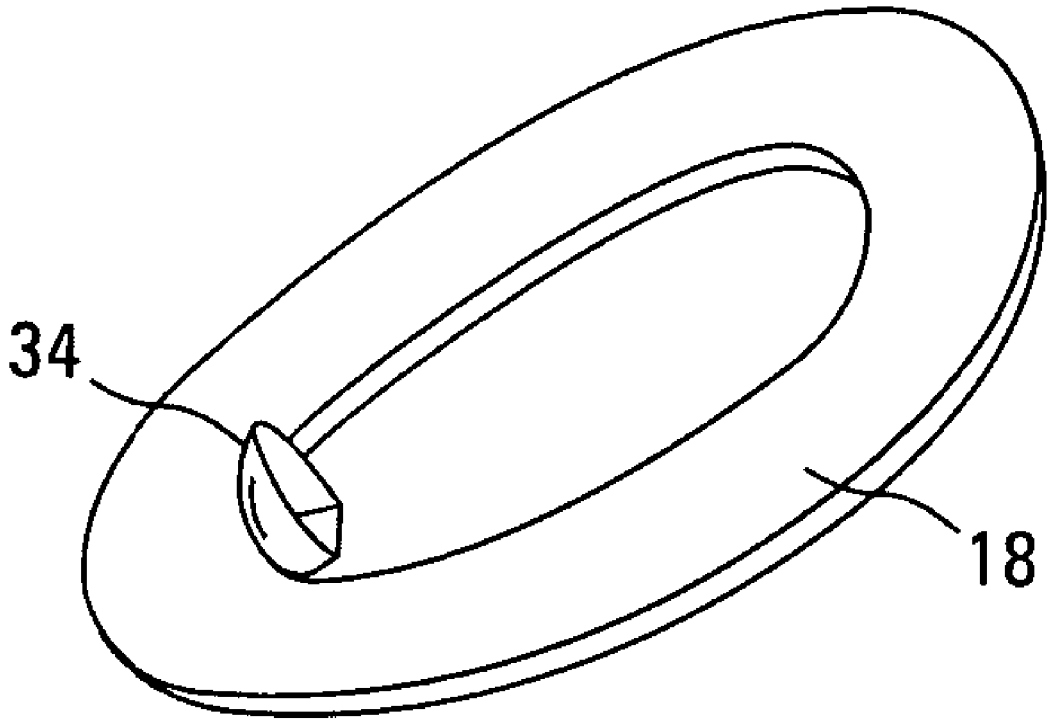
FIG. 2 is a perspective view of a child-sized toilet seat similar to that shown in FIG. 1, with the urine deflector attached.

In FIG. 2 urine deflector 34 is shown attached to child-sized toilet seat 18.

Figure 3:
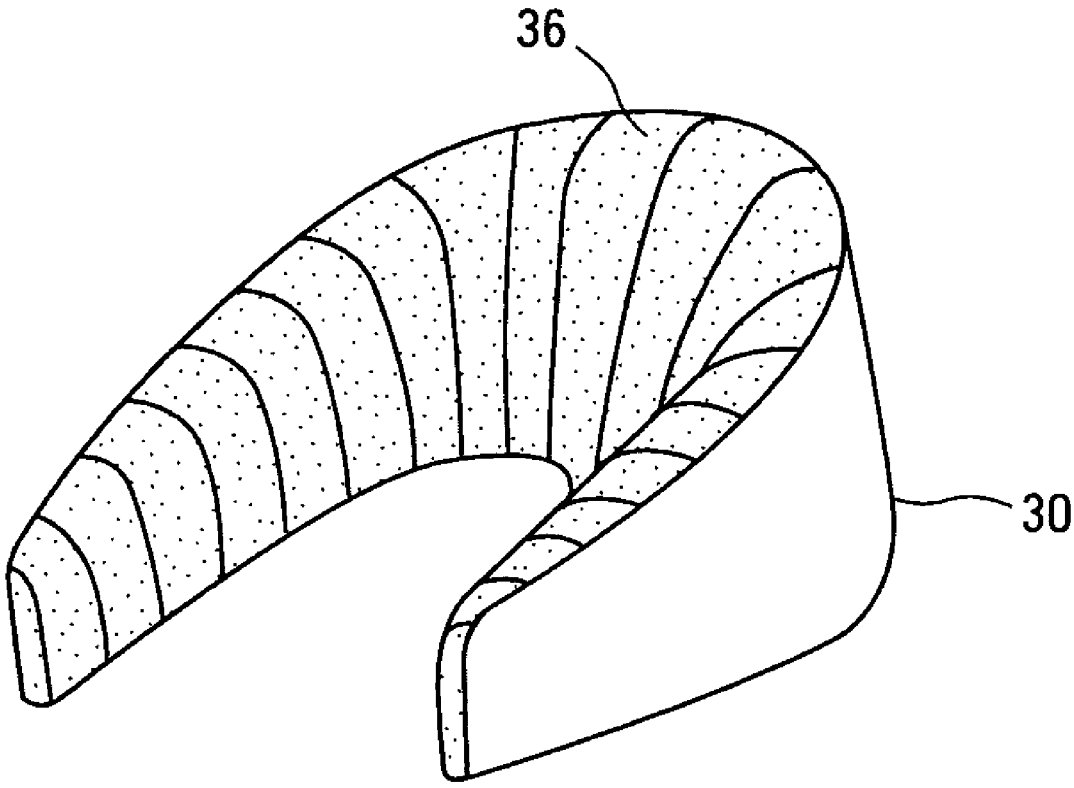
FIG. 3 is a perspective view of a padded liner similar to that shown in FIG. 1.

In FIG. 3 the padding 36 for liner 30 is shown.

Figure 4:
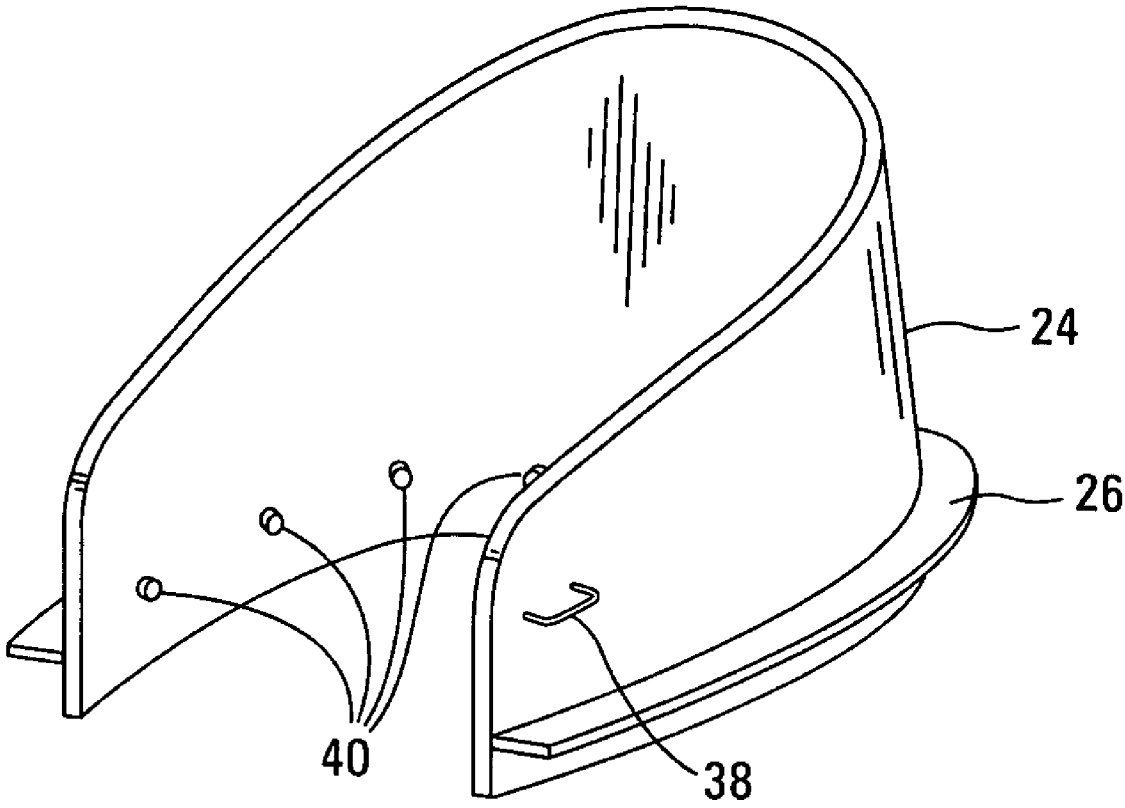
FIG. 4 is a perspective view of a vertical curvilinear element similar to that of FIG. 1, but showing a horizontal rest and an attachment for a safety belt on the outside surface of the curvilinear element and a series of tabs on the inside surface thereof.

FIG. 4 shows vertical curvilinear element 24 with a horizontal rest 26 and an attachment for a safety belt 38 on the external surface of element 24 and a series of tabs 40 on the inside surface of element 24.

To use the toilet training system of the present invention in a child's sit-down toilet mode, the toilet seat cover 16 and toilet seat 14 of a conventional toilet 10 are placed in the raised position as shown in FIG. 1. The vertical curvilinear element 24 is then placed upon the rim of toilet bowl 12 so that horizontal rest 26 serves as the base of element 24. The bottom portion of element 24 (shown in phantom) projects below the rim of toilet bowl 12 and is held snugly or adjusted to fit snugly within the upper part of toilet bowl 12. The vertical curvilinear element preferably is fabricated from a high impact plastic which is washable and is designed so that the interior surface does not contain any pockets or ledges or other obstructions capable of trapping urine. Padded liner 30, which can be fabricated of the same plastic material as the vertical curvilinear element, is then placed in front of element 24 and snapped in position abutting element 24. Alternatively, liner 30 can be provided in the form of a sleeve, for example, a washable vinyl sleeve, and slipped over element 24. The child-sized toilet seat 18, which is preferably padded, is then placed upon the upper rim of toilet bowl 12 and tabs 40 on the inside surface of vertical curvilinear element 24. The child-sized toilet seat 18 is held in position by means of vertical lip 22, which will abut the inside surface of the front of toilet bowl 12 and be held snugly therein. If desired, urine deflector 34, which can be fabricated of a washable plastic, can be fitted upon the child-sized toilet seat 18, as shown in FIG. 2. In this mode, the vertical curvilinear element 24 and padded liner 30 together serve as a comfortable backrest for the child-sized toilet seat 18. The system can then be used for sit-down toilet training of children. With the urine deflector 34 attached the system is particularly advantageous for training girls.

When it is desired to use the toilet in the stand-up urinal mode, the child-sized toilet seat and the padded liner 30 are removed. The vertical curvilinear element 24 now will serve as a urine shield for boys learning to urinate while standing.

In order to return the toilet to use for sit-down toilet training any traces of urine remaining on the curvilinear element 24 or on toilet 10 are rinsed or wiped off. Then the padded liner 30 is placed on or in the vertical curvilinear element 24 and the child-sized toilet seat 18, with the urine deflector attached, if desired, is replaced. The system then provides a child-sized toilet seat with a comfortable backrest and can be used in the sit-down toilet mode.

Thus, the system of the present invention provides the means for both stand-up and sit-down toilet training of children.

The foregoing discussion discloses and describes merely exemplary embodiments of the present invention. One skilled in the art will readily recognize from such discussion and from the accompanying drawings and claims that various changes, modifications, and variations can be made therein without departing from the spirit and scope of the invention as defined in the following claims.

The invention claimed is:

1. A multi-purpose toilet training system for use alternatively in a child's sit-down toilet mode and a child's stand-up urinal mode comprising:

a child-sized toilet seat, and a vertical curvilinear element having a horizontal rest extending around the exterior periphery thereof to provide a base for placement upon the rim of a full-sized toilet bowl, said vertical curvilinear element being adapted to extend below the rim of a full-sized toilet bowl, and a plurality of tabs around the interior periphery of said vertical curvilinear element for placement of said child-sized toilet seat.

2. The toilet training system of claim 1, which additionally comprises a padded liner for said vertical curvilinear element to provide a backrest cushion for use in a child's sit-down toilet mode.

3. The toilet training system of claim 2, wherein said padded liner has an overhang for positioning in front of said vertical curvilinear element.

4. The toilet training system of claim 1, wherein said vertical curvilinear element has a handle on the exterior surface thereof.

5. The toilet training system of claim 1, wherein said vertical curvilinear element has an attachment for a safety belt on the exterior surface thereof.

6. The toilet training system of claim 1, wherein said child-sized toilet seat is padded.

7. The toilet training system of claim 1, which additionally comprises a urine deflector adapted for mounting at the front of said child-sized toilet seat for use in a child's sit-down toilet mode.

* * * * *